US005584632A

United States Patent [19]

Stiles et al.

[11] Patent Number: 5,584,632

[45] Date of Patent: Dec. 17, 1996

[54] SPIRAL BINDING METHOD AND APPARATUS

[75] Inventors: William P. Stiles, Bothell; Sean M. MacLeod, Renton; Michael D. Nelson, Seattle; Mark E. Hastings, Mukilteo; David A. Herrin, Seattle, all of Wash.

[73] Assignee: Unicoil, Inc., Norcross, Ga.

[21] Appl. No.: 320,283

[22] Filed: Oct. 11, 1994

[51] Int. Cl.[6] ..... B42B 5/10

[52] U.S. Cl. ..... 412/39

[58] Field of Search ..... 412/1, 6, 7, 9, 412/33, 38, 39, 40

[56] References Cited

U.S. PATENT DOCUMENTS

| | | | |
|---|---|---|---|
| 3,122,761 | 3/1964 | Bouvier | 11/1 |
| 3,153,966 | 10/1964 | Frederick et al. | 83/571 |
| 3,227,023 | 1/1966 | Bouvier | 83/549 |
| 3,367,649 | 2/1968 | Thomas et al. | 271/10 |
| 3,427,914 | 2/1969 | Staats et al. | 83/467 |
| 3,459,074 | 8/1969 | Pfaffle | 77/22 |
| 3,459,242 | 8/1969 | Schmidt | 140/92.93 |
| 3,467,150 | 9/1969 | Ostermeier | 140/92.94 |
| 3,486,537 | 12/1969 | Sickinger | 140/92.94 |
| 3,592,242 | 7/1971 | Sickinger | 140/92.94 |
| 3,793,660 | 2/1974 | Sims | 11/1 AC |
| 3,818,954 | 6/1974 | Pfaffle | 140/92.3 |
| 3,826,290 | 7/1974 | Pfaffle | 140/92.7 |
| 3,889,309 | 6/1975 | Adams et al. | 412/39 |
| 3,924,664 | 12/1975 | Pfäffle | 140/92.7 |
| 3,967,336 | 7/1976 | Cutter | 412/40 X |
| 3,972,109 | 8/1976 | Sickinger | 29/434 |
| 4,129,156 | 12/1978 | Pfaffle | 140/92.4 |
| 4,129,913 | 12/1978 | Pfaffle | 11/1 A |
| 4,143,686 | 3/1979 | Sickinger et al. | 140/92.93 |
| 4,185,668 | 1/1980 | Harbert | 140/92.4 |
| 4,208,750 | 6/1980 | Pfaffle | 11/1 A |
| 4,249,278 | 2/1981 | Pfäffle | 412/7 |
| 4,378,822 | 4/1983 | Morris | 140/92.3 |
| 5,211,522 | 5/1993 | Ho | 412/40 X |

FOREIGN PATENT DOCUMENTS

| | | |
|---|---|---|
| 717238 | 9/1965 | Canada . |
| 806461 | 2/1969 | Canada . |

*Primary Examiner*—Willmon Fridie, Jr.
*Attorney, Agent, or Firm*—Christensen O'Connor Johnson & Kindness PLLC

[57] ABSTRACT

An apparatus (10) for spiral binding a stack of papers (24) together as a unit. The apparatus includes a punch (12) for punching a plurality of holes (23) along one edge of the stack of papers and a spiral binding unit (14) for feeding a spiral coil (36) into the holes. The spiral binding unit (14) includes an aperture (44) through which a coil is inserted between a shoe (74) and a rotatably mounted roller (72). As the coil (36) is inserted, the shoe (74) pushes the coil into contact with the roller (72). As the roller (72) rotates, the coil (36) is guided through a series of slots (86) which cause the coil to spiral into the holes in the stack of paper. The punch (12) includes a ramp (186) that presses a series of punch pins (188) through the stack of papers. The ramp (186) includes a plurality of steps (222) that incline upwardly on either side of a center step (224). The punch first punches holes in the center of the stack of papers and then punches holes outward from either side of the center. The apparatus includes indicators (38) that provide an operator an indication of the appropriate size of spiral coil to use, and an indication of when a wastebasket (52) holding the wastepaper requires emptying.

31 Claims, 11 Drawing Sheets

SPIRAL BINDING METHOD AND APPARATUS

FIELD OF THE INVENTION

The invention relates generally to methods and apparatus for binding sheets of paper or other materials together, more specifically, the invention relates to the spiral binding of sheets of paper or other flat stock materials.

BACKGROUND OF THE INVENTION

Many methods of binding sheets of paper or other flat stock materials together as a unit have been developed in the past, including book binding, Velobinding®, spiral binding, etc. Each method has its own advantages and disadvantages. Classic book binding, although preferred in many applications, requires equipment and manufacturing techniques that generally do not lend themselves to low volume binding, such as that required in small companies, offices, print shops, etc. Velobinding may be performed with equipment readily available to small offices or print shops. The bound unit produced by Velobinding requires a large margin on the left-hand side and does not allow the resulting unit to be easily laid open for viewing.

Spiral binding allows a stack of papers to be bound together as a unit that is easily opened to any page, thus making it very acceptable in the marketplace. However, in the past the equipment required to spiral bind a stack of papers has not lent itself to application in small businesses, offices, print shops, etc., due to the expense and complexity of the binding equipment.

In spiral binding, a series of equally-spaced holes are punched in one edge of the stack of papers. A continuous spiral coil is then fed or spiraled through the holes to form a bound unit. Spiral binding has been a preferred method of binding for many years and a number of manufacturers sell equipment to perform spiral binding.

Typically, a pre-wound spiral coil is placed around an appropriately sized mandrel or a coil is wound over the mandrel. The stack of papers to be bound together is first punched along one edge and then positioned near the end of the mandrel. A roller is moved into contact with the outer surface of the spiral coil, pressing the inner surface of the coil against the mandrel. The free end of the spiral coil extending out from one end of the mandrel is placed within the first hole in the stack of papers. The roller is then rotated, causing the coil to rotate. As the roller rotates, the coil spirals into the holes in the stack of papers, binding them together as a unit. Exemplary prior art equipment used to perform spiral binding is disclosed in U.S. Pat. Nos. 4,378,822, issued to Morris and 4,249,278 issued to Pfaffle.

Most prior spiral binding equipment is large, complex, and designed for use in assembly lines where commercially produced spiral bound units are manufactured. Some prior art equipment is manufactured for use in smaller applications, such as offices, small businesses, or print shops. However, such equipment is expensive, and difficult and time consuming to use. Typically, one piece of equipment is purchased to punch appropriately spaced holes in the stack of papers and a second piece of equipment is purchased to spiral a coil into the stack of punched paper. In spiral binding equipment, such as that disclosed in the Morris patent, an operator manually positions a punched stack of papers so that the holes are positioned in line with a coil placed over a mandrel. The operator then manually starts the end of the coil into the holes in the paper. As described above, the operator then switches on the equipment so that a roller presses the coil against the mandrel, spiraling the coil into the holes in the paper.

During spiraling, it is common for the coil to deform slightly causing it to miss the holes in the paper, resulting in the coil binding or spiraling off the edge of the paper. One of the contributors to coil deformation is the fact that the coil is driven from only one edge of the paper, thus creating greater stresses within the coil as it spirals further along the length of the paper. When the coil binds or spirals off the edge of the paper, the rotation of the roller and coil must be reversed and the coil spiraled backward until it moves back into position. The spiraling process is then repeated until the coil spirals through all of the holes over the length of the stack of papers being bound.

If stacks of different thicknesses are to be bound together as a unit, the operator must maintain different size mandrels on hand. In order to use different size coils, it is necessary for the operator to exchange the mandrels in the apparatus to correspond with the size coil that is being used.

In other spiral binding equipment, the coil is started into the holes at one end of the stack of papers manually. The portion of the coil spiraled into the stack of papers is then pressed against two parallel, rotating rollers that extend along the edge of the stack of papers. As the coil is pressed against the moving rollers, the rollers contact the coil and spiral it into the holes in the paper. This type of spiral binding equipment also deforms the coil, causing it to miss holes in the stack of paper. Thus, an operator must reverse the rotation of the coil, reposition the coil and restart the operation.

Past spiral binding equipment is bulky, difficult to use, expensive, and poorly esthetically designed. In addition, prior spiral binding equipment has a number of moving parts. As with any equipment with moving parts, safety concerns are always an issue.

As can be seen from above, there is a need for improved methods and apparatus to spiral bind a stack of papers together as a unit. One goal of the present invention is to reduce some of the problems associated with prior apparatus and methods thus helping to meet this need.

SUMMARY OF THE INVENTION

The present invention is a spiral binding apparatus. One embodiment of the invention includes a punch and a spiral binder in a single unit. The spiral binder includes a feeder that rotatably feeds a preformed spiral coil into holes in a stack of papers or other sheet stock material to form a bound unit. Throughout this application, stack of papers is used interchangeably to mean paper, cardboard, plastic, or any other sheet stock materials. The feeder includes a rotatably mounted roller that contacts one side of the coil as it is fed into the apparatus. The feeder also includes a shoe that is spaced radially outward from the surface of the roller and contacts the side of the coil opposite the roller. The shoe pushes the coil into contact with the roller as the coil is fed through the feeder. The rotation of the roller spirals the coil through the feeder and into the holes in the stack of paper.

In accordance with other aspects of the invention, the feeder includes a plurality of guides that maintain the individual coils that form the spiral coil at the proper pitch as it is fed into the stack of papers. The guides are spaced over the length of the stack of papers to ensure that the coil is properly fed into the holes over the length of the paper.

In accordance with other aspects of the invention, the shoe is movable toward and away from the roller in order to allow the feeder to accept different diameter coils. The apparatus also includes a means for providing the operator an indication of the proper size coil to be used to bind the stack of papers.

In accordance with still further aspects of the invention, the apparatus includes a bar for holding down the stack of papers as they are bound. The bar may be used to provide the operator an indication of the thickness of a stack of papers. The apparatus may also include means to provide the operator an indication of when a wastebasket used to hold wastepaper requires emptying.

In accordance with other aspects of the invention, the punch includes a reciprocating ramp and a plurality of punch pins slidably mounted below the ramp. The ramp includes a center step and side steps that incline upward on both sides of the center step. The punch also includes an actuator for moving the ramp into contact with the punch pins so that the center step contacts and pushes the punch pins below it through the center of the stack of papers and then the side steps contact and push the punch pins below them through the stack of papers. The punch punches holes in the center of the stack of papers first and then outward from the center of the stack of papers to both edges of the stack of papers.

In accordance with yet other aspects of the invention, a method of punching and spiral binding a stack of papers is also disclosed.

The present invention eliminates a number of the disadvantages associated with prior art spiral binding methods and apparatus. One embodiment of the present invention includes both a punch for punching holes in the stack of paper and a spiral binder for spiraling a pre-formed coil into the holes on the edge of the paper. The invention's use of a shoe that moves toward and away from a rotatably mounted roller allows the invention to accommodate coils of varying diameters and sizes thus eliminating the need for mandrels of different sizes. The invention also locates the moving parts of the spiral binder within a protective housing thus reducing or eliminating the chance of injury to the operator.

The spiral binding apparatus of the present invention is easy to use, fast and economical. In addition, the invention provides the operator an indication of the proper coil diameter to be used thus helping to ensure good results.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
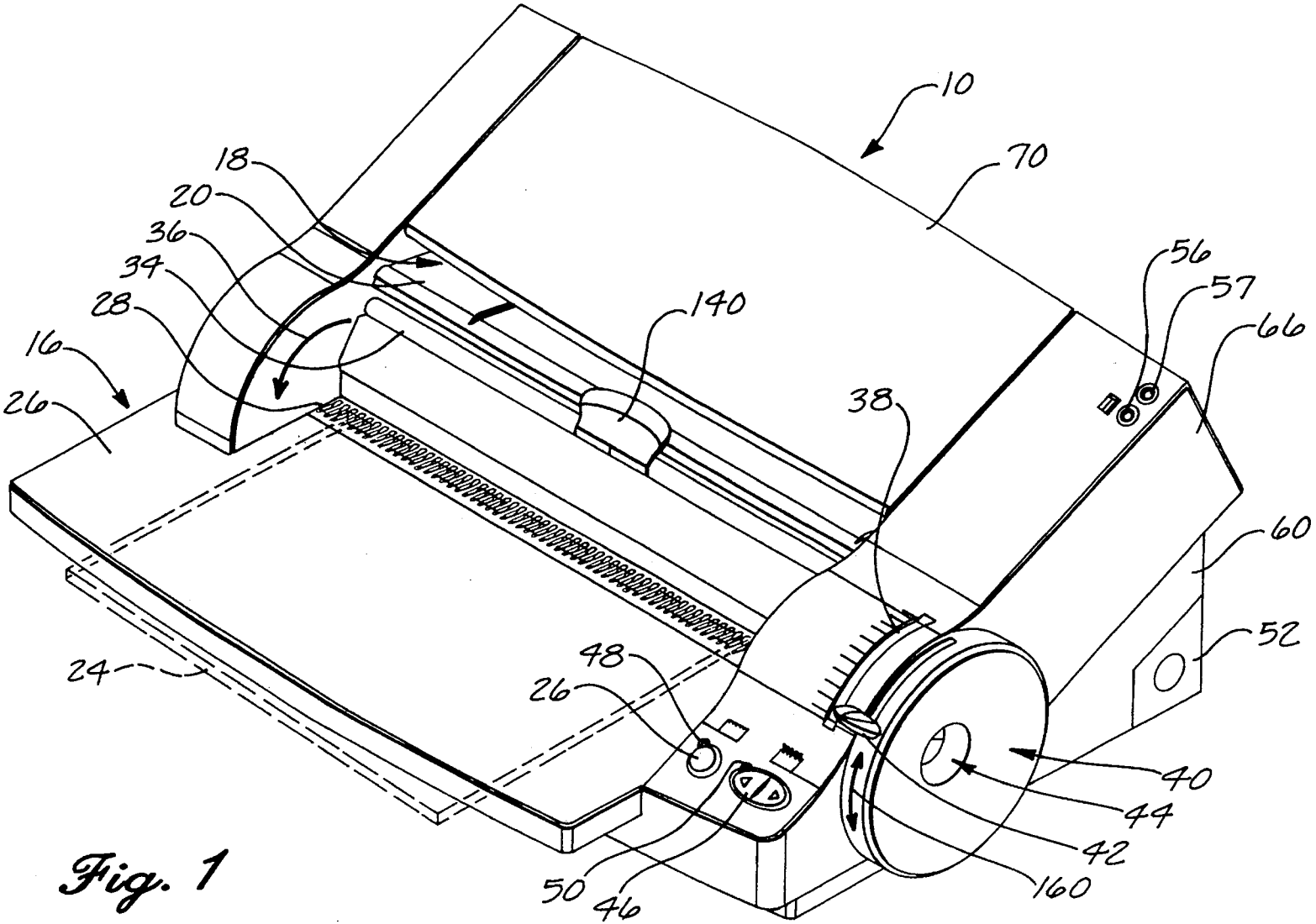
FIG. 1 is a perspective view of a combined punch and spiral binding apparatus formed in accordance with the present invention.
Figure 11:
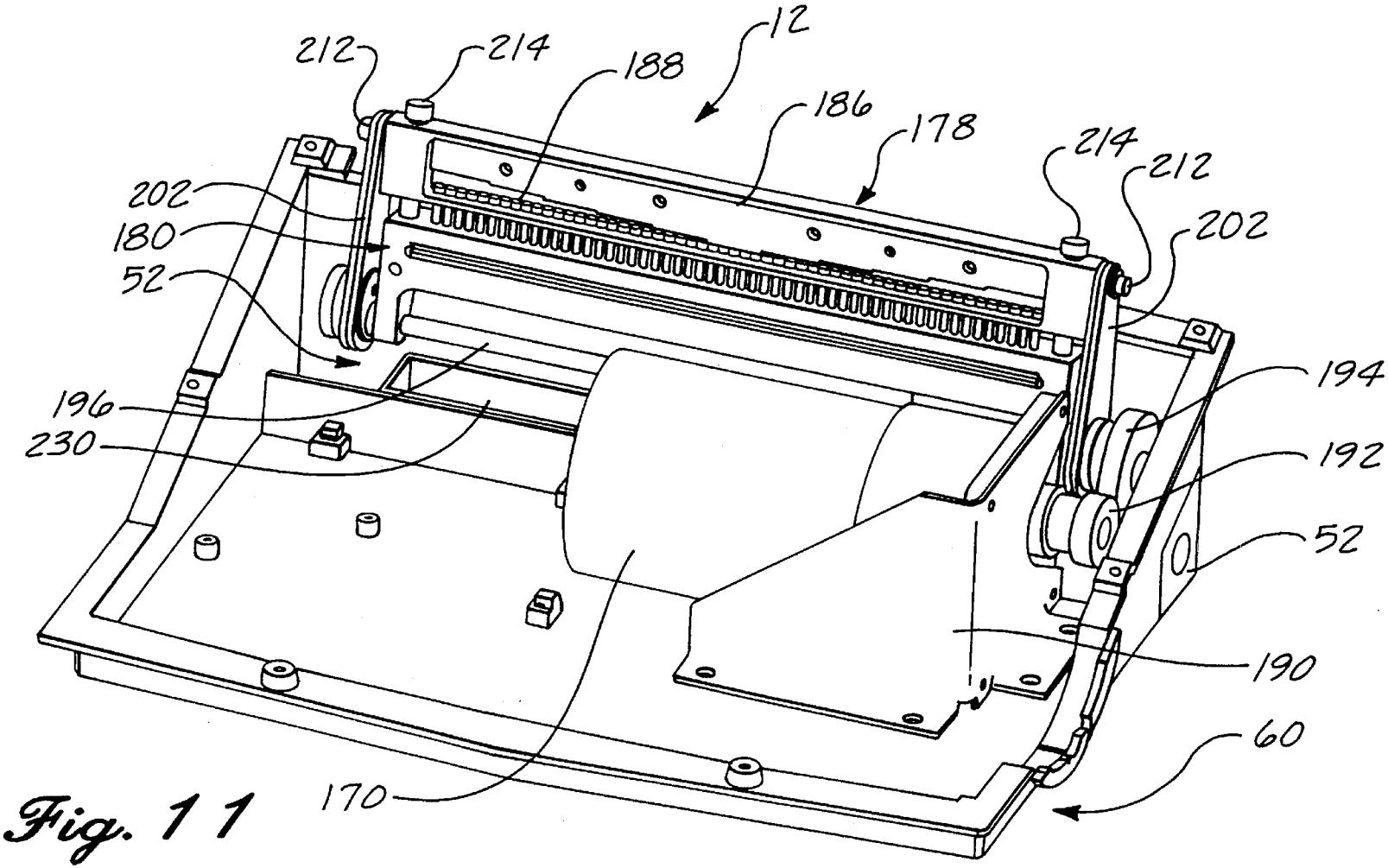
FIG. 11 is a perspective view of the punch.

A combined punch and spiral binder 10 formed in accordance with the present invention is illustrated in FIG. 1. The punch and spiral binder 10 includes a punch section 12 (FIG. 11) and a spiral binding section 14 (FIG. 3) both contained within a housing 16. One or more sheets of paper or other flat sheet stock material may be punched by inserting and aligning the material through a slot 18 (FIG. 1) in the upper portion of the binder 10. The stack of papers 24 to be punched is inserted through the slot 18, so that it rests upon the punch platform 20, and is pushed backward a sufficient distance to enter the punch section 12 as described in detail below. Once fully inserted into the slot 18, a plurality of equally spaced holes 23 (FIG. 3) are punched in the rear edge of the stack of papers 24 by depressing a punch button 26 (FIG. 1) on the housing 16.

Figure 3:
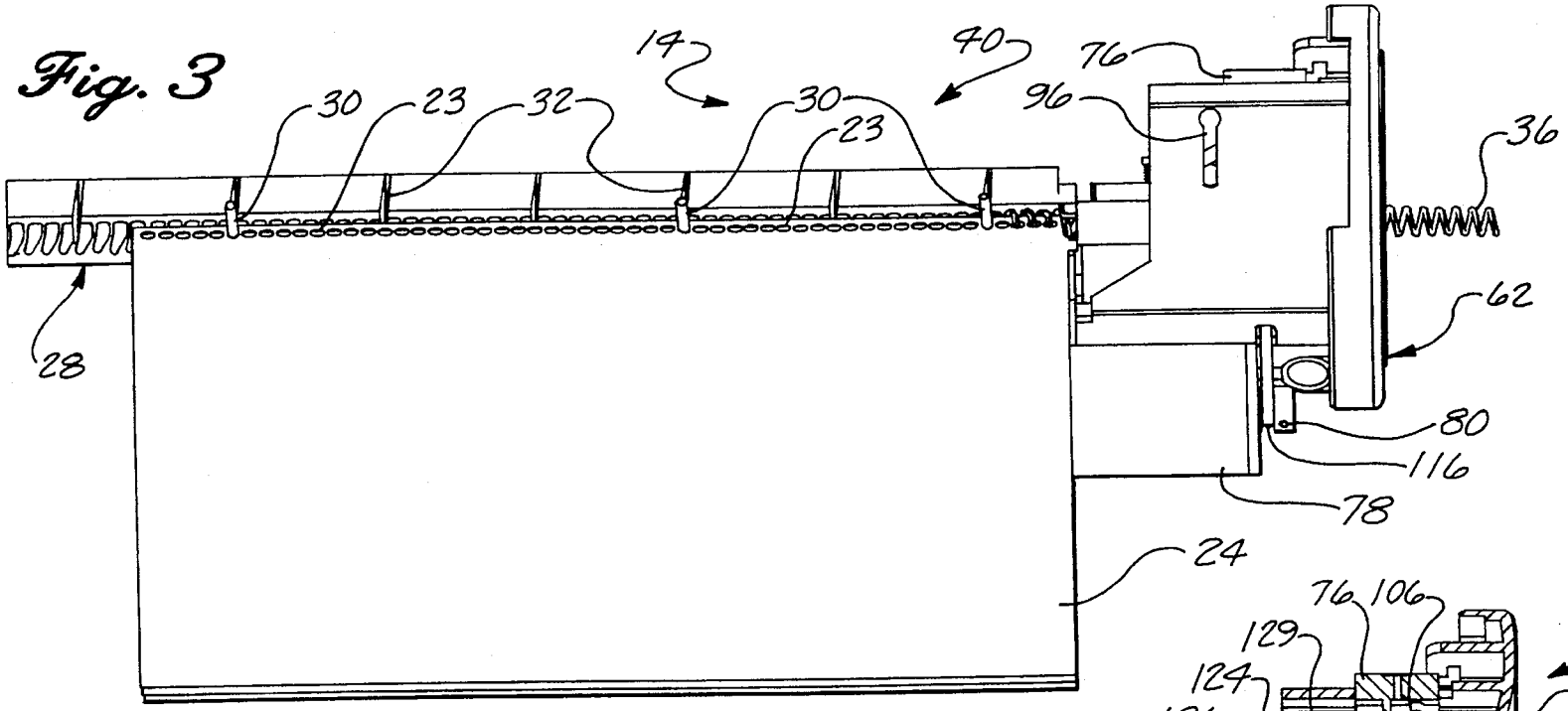
FIG. 3 is an enlarged, plan view of the coil feeder and guide plate of the apparatus of FIG. 1.

Once punched, the stack of papers 24 is removed from the slot 18 and placed on the binding platform 26 (FIG. 1) so that the holes 23 in the stack of papers are properly positioned over a guide plate 28 (FIGS. 1 and 3). A series of locator pins 30 (FIG. 3) and locator spacers 32 on the guide plate 28 assist the operator in properly locating the stack of papers 24 as described in detail below. Once properly positioned, a paper hold down bar 34 (FIGS. 1 and 9) is pulled downward using a tab 140, as indicated by arrow 36, to apply a force on the upper surface of the stack of papers 24 in the direction of the binding platform 26. This downward directed force helps to maintain the stack of papers 24 in position while binding. In addition to holding the stack of papers 24 in position, the bar 34 provides an indication of the thickness of the stack of papers 24. This indication of thickness is used to suggest an optimum spiral coil diameter to the operator by illuminating an indicator 38 on the front of the housing 16 as described more fully below. The operator then selects the proper spiral coil size based on the information provided by the indicator 38. The coil feeder 40 is then set to the proper diameter by sliding a selection tab 42 to the appropriate position.

The operator then inserts a spiral coil 36 (FIG. 3) into an aperture 44 (FIG. 1) in the coil feeder 40. The operator then depresses a binding button 46, which causes the coil feeder 40 to spiral the coil 36 through the holes 23 in the stack of papers 24 (FIG. 3), thus binding the stack of papers 24 together as a unit.

In addition to the features identified above, the binder 10 includes an indicator light 48 (FIG. 1) that indicates when the stack of papers 24 is fully inserted into the punch slot 18, an indicator light 50 that indicates when the bind button should be pushed to advance the coil, a removable wastebasket 52 that collects waste material, an indicator 56 that indicates when the wastebasket needs emptying, and a power on indicator 57.

Figure 2:
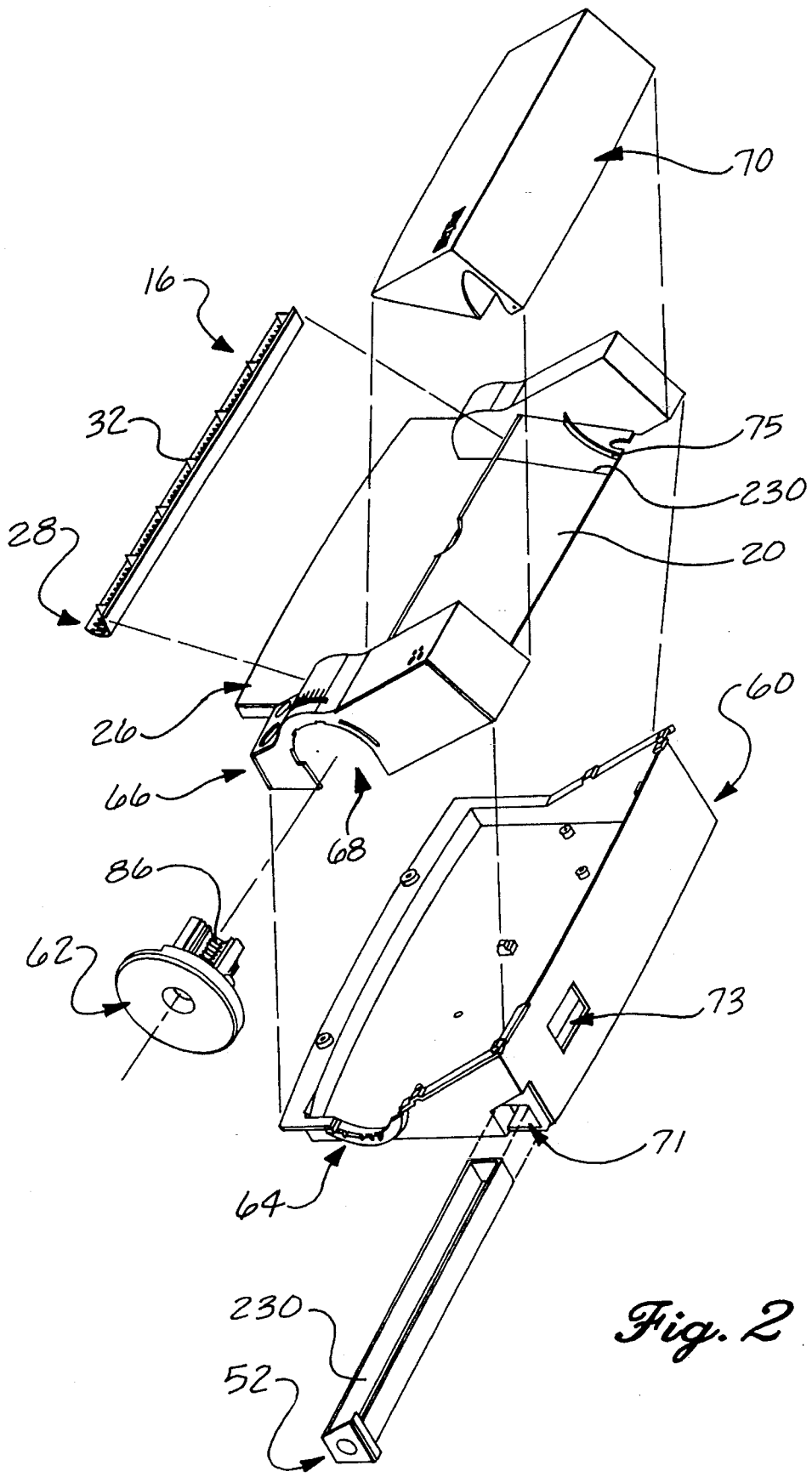
FIG. 2 is an exploded view of the external housing, covers and wastebasket of the apparatus of FIG. 1.

The individual parts and operation of the binder 10 including the punch section 12 (FIG. 11) and spiral binding section 14 (FIG. 5) will now be described in more detail. The housing 16 (FIG. 2) of the spiral binder 10 is formed of a number of separate parts to ease assembly, disassembly, and maintenance. The base 60 of the housing is adapted to set on the top of a table or other surface and contains the mounting structure for the punch section 12 (FIG. 11) and the wastebasket 52. A spiral binding cover 66 fits over the top of the base 60. The binding cover 66 includes the punch platform 20, binding platform 26, and cutouts for the punch button 26, binding button 46, and indicators 48, 50 and 56. The binding cover 66 also includes a rectangular cutout 70 (FIG. 1) extending along the rear edge of the binding platform 26. An elongated rectangular guide plate 28 is mounted within the cutout 70 to guide the spiral coil through the holes 23 (FIG. 3) in the stack of papers 24 during binding as described below.

A punch cover 70 is mounted on the binding cover 66, above the punch platform 20 and punch section 12. The lower surface of the punch cover 70 and the surface of the punch platform 20 define the punch slot 18. The base 60 includes a semi-circular cutout 64 that is located in line with a semi-circular cutout 68 in the binding cover 66. The housing 62 for the coil feeder 40 is mounted within the cutouts 64 and 68.

The base 60 includes a rectangular opening 71 in one side to slidably receive the wastebasket 52. The base also includes a cutout 73 in its rear wall to accommodate a power cord and on/off. switch. The punch platform 20 includes two upwardly extending opposing guides 75. The guides 75 curve inward from the sides of the platform to help properly position the stack of papers 24 as it is inserted into the punch slot 18.

The spiral binding section 14 (FIG. 5) is attached to the base 60 and binding cover 66 through the use of the feeder housing 62. The spiral binding section 14 includes a rotatably mounted roller 72, a slidably mounted shoe 74, an adjustment slide 76 to adjust the shoe 74, a motor 78 including a pulley 80, a motor mount 82 and the guide plate 28.

Figure 4:
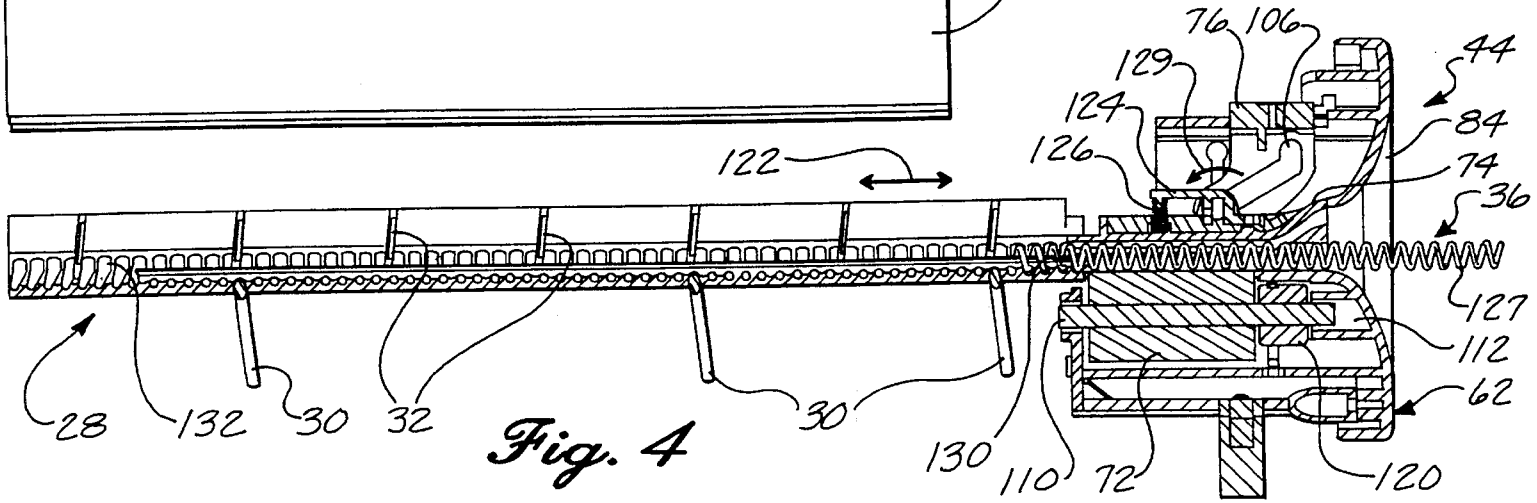
FIG. 4 is an enlarged, cross section of the coil feeder and guide plate of FIG. 3.
Figure 5:
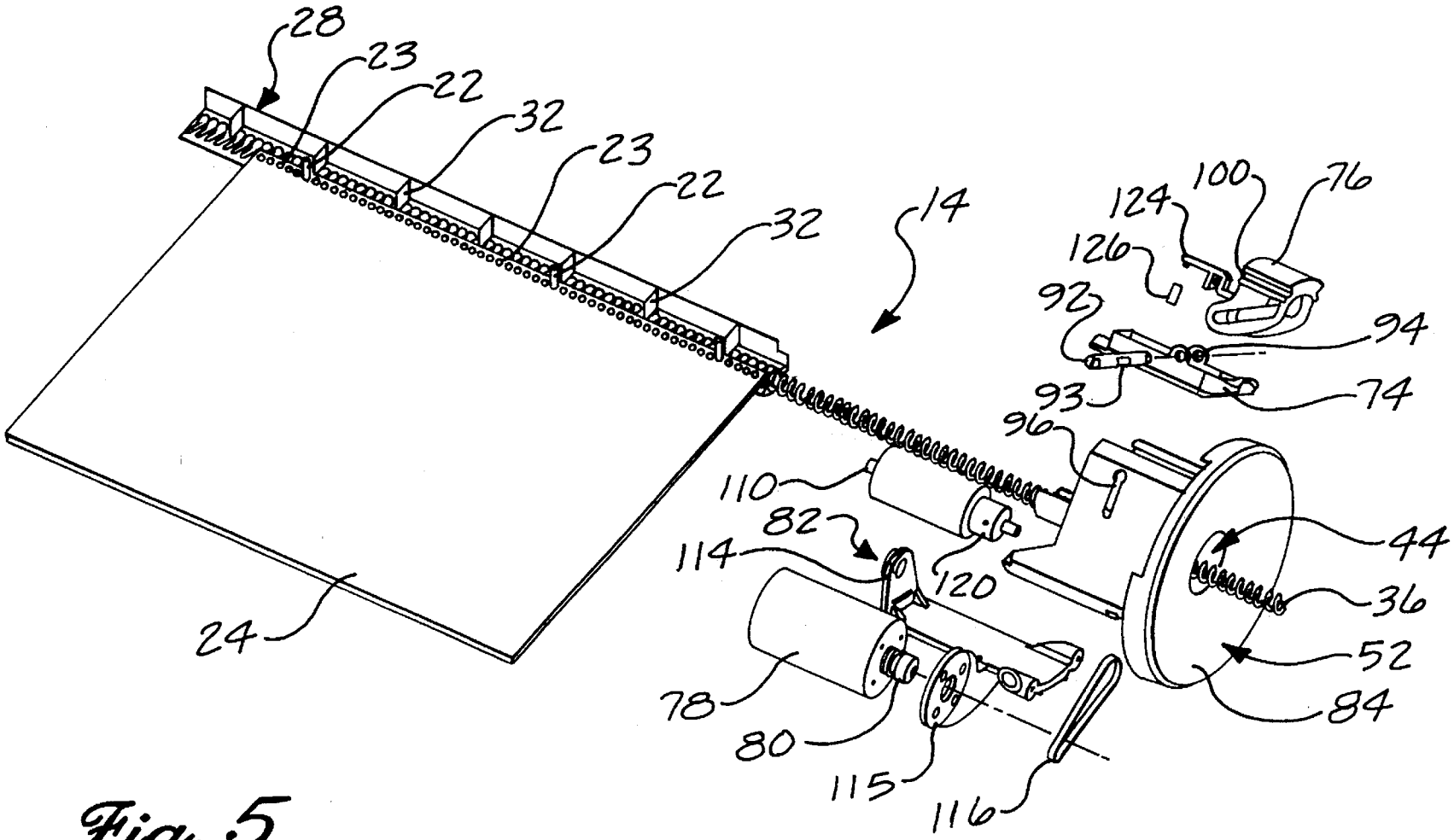
FIG. 5 is an exploded, perspective view of the coil feeder and guide plate of FIG. 3.
Figure 6:
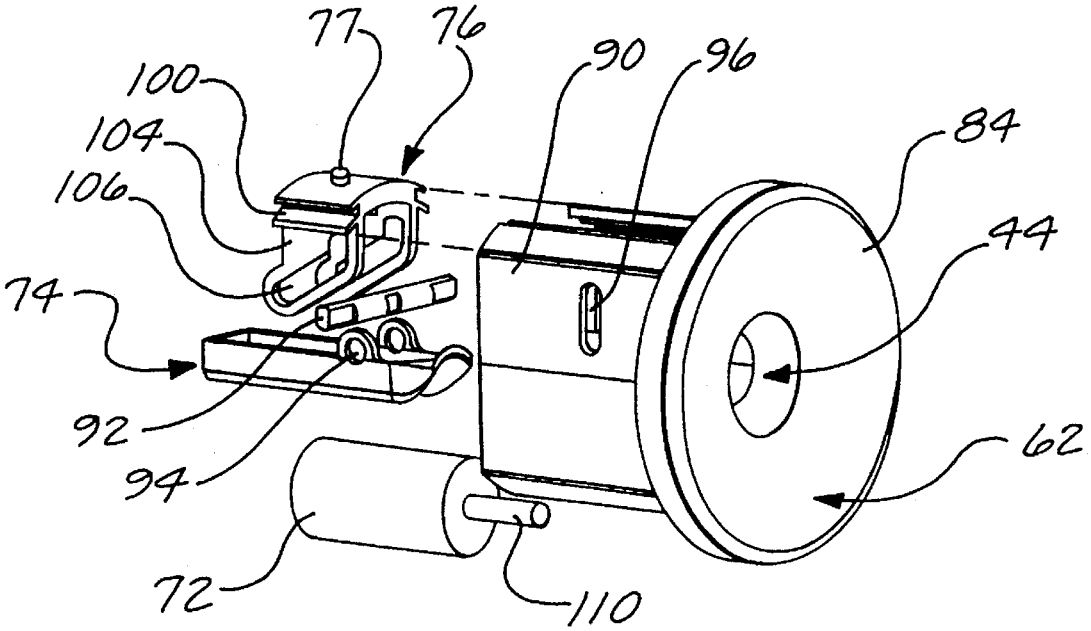
FIG. 6 is an enlarged, exploded view of part of the coil feeder of FIG. 5.
Figure 7:
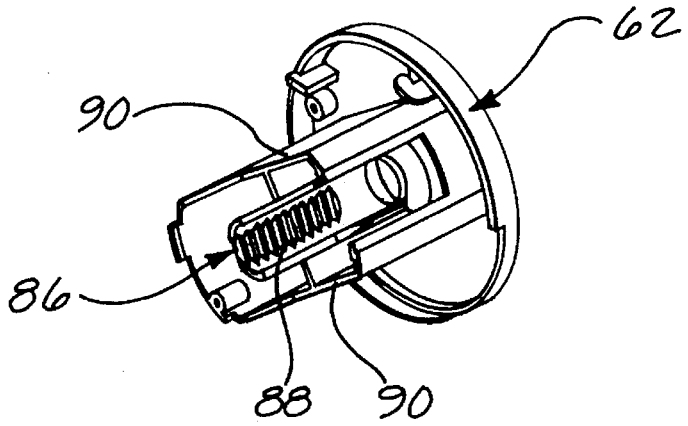
FIG. 7 is a perspective view of the feeder housing.

As best seen in FIGS. 4 and 6, the exterior surface 84 of the housing 62 is shaped as a funnel leading into the aperture 44 during insertion. The funnel guides the coil 36 into the center of the aperture 44. As the coil 36 is inserted into the aperture 44, it extends between the upper surface of a feeder guide 86 (FIG. 7) and the lower surface of the shoe 74 (FIGS. 5 and 6). The upper surface of the feeder guide 86 contacting the coil 36 is concave and includes a series of guides or slots 88 (FIG. 7) that extend through the thickness of the feeder guide. The slots 88 are slanted so that their pitch corresponds to the pitch of the individual coils forming the spiral coil 36. The lower surface of the shoe 74 that contacts the coil is also concave so that it partially surrounds the upper surface of the coil as it moves between the shoe 74 and feeder guide 86.

The shoe 74 is slidably mounted between two opposing parallel walls 90 (FIGS. 7 and 8) extending inward from the exterior surface 84, using a clevis shaft 92 (FIGS. 5 and 6). The clevis shaft 92 is cylindrical and includes rectangular opposing ends and a rectangular center portion 93. The cylindrical portion of the clevis shaft 92 extends through the holes 94 to allow rotational movement of the shoe 74 with respect to the clevis shaft. The rectangular opposing ends of the clevis shaft 93 extend into slots 96 (FIG. 5) in the opposing walls 90. The clevis shaft 92 slides up and down within the slots 96, but is prevented from rotating by the rectangular ends contacting the slots.

The clevis shaft 92 and attached shoe 74 are slide movable up and down toward and away from the feeder guide 86 using the adjustable slide 76. The adjustable slide 76 includes an upper portion having opposing slots 100 (FIGS. 5 and 8) extending the length of either edge. The slots 100 are sized to slidably receive inwardly extending shoulders 102 formed on the opposing upper edges of the walls 90. The slots 100 and shoulders 102 allow the adjustable slide 76 to move inward and outward on the shoulders 102 toward and away from the exterior surface 84. The slide 76 includes opposing downward extending walls 104 (FIG. 6), forming a clevis extending on either side of the shoe 74. The cylindrical portion of the clevis shaft 92 extends through an inclined slot 106 in each wall 104. Each slot 106 inclines downward and inward from the side of the walls 104 closest to the exterior surface 84.

As the slide 76 moves inward away from the exterior surface 84, the clevis shaft 92 rises upward within the inclined slots 106 and slots 96 causing the shoe 74 to move away from the feeder guide 86. Similarly, sliding the slide 76 toward the exterior surface 84 causes the shoe 74 to move downward within the slots 106 and 96 toward the feeder guide 86. The sliding movement of the slide 76 increases or decreases the distance between the concave lower surface of the shoe 74 and the concave upper surface of the feeder guide 86, changing the diameter of the aperture 44. Changing the diameter of the aperture 44, in turn, allows different size coils 36 to be fed into the feeder housing 62.

As a coil 36 is fed into the aperture 44, the shoe 74 guides the individual coils forming the coil 36 into the slots 88 (FIG. 7) in the feeder guide 86. The individual coils extend through the slots 88 to contact the outer surface of the rotatably mourned roller 72 as best seen in FIG. 4. One end of the shaft 110, upon which the roller 72 is mounted, is rotatably mourned within a recess 112 on the inner surface of the feeder housing 62. The opposite end of the shaft 110 is rotatably mounted within an aperture 114 (FIG. 5) in the motor mount 82.

The motor mount 82 is attached to the feeder housing 62 and includes a mounting plate 115 onto which the motor 78 is attached using fasteners such as screws. The motor 78 rotatably drives the roller 72 by means of a drive belt 116 that extends around the pulley 80, mounted on the shaft of the motor, and a second pulley 120 mounted on the shaft 110, adjacent the roller 72. As the motor 78 rotates the roller 72, the roller contacts and rotates the coil 36 within the feeder guide 86. As the coil 36 rotates, the pitch of the slots 88 in the feeder guide 86 cause the coil to move to the left or right, as illustrated by arrow 122 in FIG. 4.

It has been found advantageous that the shoe 74 push the coil 36 into contact with the roller 72 by applying a greater force at the inner edge of the shoe than at the outer edge of the shoe adjacent the exterior surface 84. In order to provide a greater force on the inner edge, a lever 124 (FIGS. 4 and 5) is mounted on the rectangular center portion 93 of the clevis shaft 92 directly above the shoe 74. The outer end of the lever 124 is positioned over the outer end of the shoe 74 while the inner end of the lever 124 is positioned over the inner end of the shoe 74. A biasing spring 126 is mounted between the inner end of the lever 124 and the shoe 74.

The clevis shaft 92 is positioned forward of the center of the shoe 74 and lever 124 such that the lever 124 and shoe 74 extend a further distance inward from the clevis shaft than they extend outward from the clevis shalt. The lever 124 prevents the outer edge of the shoe 74 from moving upward beyond a predetermined amount, and applies downward directed force on the inner edge of the shoe 74. The downward force created by spring 126 resiliently biases the coil 36 downward into contact with the roller 72.

As the outer edge 127 (FIG. 4) of the coil moves out from between the shoe 74 and roller 72, the shoe is biased counterclockwise, as indicated by arrow 129 (FIGURE FOUR). This counterclockwise bias places a greater force on the portion of the coil 36 exiting from between the shoe and roller than on the portion of the coil entering the shoe and roller from the right-hand side. The shoes bias configuration helps to prevent the coil 36 from slipping an unacceptable amount as it exits from between the shoe 74 and roller 72. In addition, the resilient biasing force provided by the spring 126 helps to prevent noise or chattering between the shoe 74 and coil 36 during operation.

In alternative embodiments, the shoe 74 can remain parallel to the roller 72 and guide 86 during operation. The shoe can also be maintained at a fixed distance from the roller and not be spring biased. In yet other embodiments, the roller 72 may be rotated manually using a handle.

Figure 8:
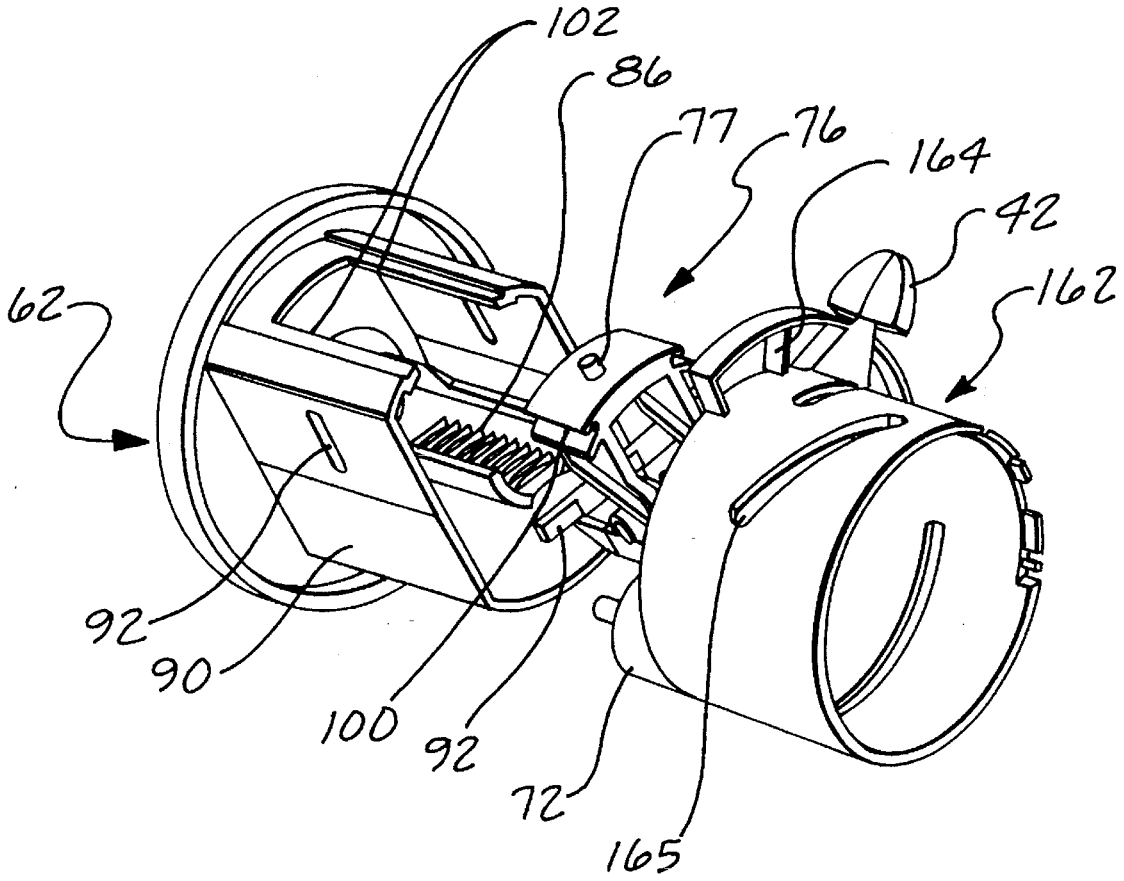
FIG. 8 is an enlarged, partially exploded view of part of the coil feeder.

As best illustrated in FIG. 8, the position of the adjustment slide 76 is adjusted by rotating the coil selection tab 42 forward or backward as illustrated by arrow 160 in FIG. 1. The rotational movement of the tab 42 is converted into translational movement of the adjustable slide 76 (FIG. 8) through the use of a cylindrical sleeve 162 that surrounds the walls 90. The sleeve 162 includes a plurality of radially extending webs 164 on which the tab 42 is mounted. The sleeve 162 also includes a radially inclined slot 165. A protuberance or nubbin 77 extends from the top of the slide 76 into the inclined slot 165. As the sleeve 162 rotates, the inclined slot 165 moves the slide 76 inward and outward, which in turn causes the shoe 74 to move toward or away from the feeder guide 86 by sliding within slots 96.

In alternate embodiments of the invention, the sleeve 162 and tab 42 can be eliminated. In such embodiments, a tab can be attached to the adjustment slide 76 and extend through the binding cover 66. The tab can be slidably moved toward or away from the exterior surface 84 of the feeder housing 62 in order to move the shoe 74 toward or away from the feeder guides 86.

As the inner edge 130 (FIG. 4) of the coil 36 moves inward beyond the inner edge of the feeder housing 62, it moves into contact with the guide plate 28 (FIGS. 3 and 4). In a manner similar to that described with respect to the feeder guide 86, the guide plate 28 includes a series of slots 132 that are inclined at the same pitch as the individual coils forming the coil 36. The slots 132 prevent the coil 36 from deforming while the coil is being fed into the holes 23 (FIG. 3) in the stack of papers 24. Thus, the slots 132 prevent the occurrence of jamming caused by the coil deforming, and thus not spiraling into the next sequential hole 23.

It is advantageous to attach the guide plate 28 and feeder guides 86 to the apparatus in a manner that allows them to be easily removed and exchanged. The guide plate 28 and feeder guide 86 may then be exchanged for guide plates and feeder guides that accommodate coils having different pitches.

It is important that the stack of papers 24 be carefully positioned upon the binding platform 26 prior to binding. Otherwise, the inner end 130 of the coil 36 may not correctly spiral into the holes 23 during binding. To assist the operator in positioning the stack of papers 24, the guide plate 28 can include a plurality of paper locators 32 that extend forward from the rear wall of the paper guide 28. The paper locators may be eliminated to save cost if locator pins 30 as described below are used. The paper locators 32 extend between individual slots 132 so that they do not interfere with the spiral binding operation. As an operator inserts a stack of papers 24 on the binding platform 26 (FIG. 1), they are positioned fore and aft by pushing them rearward into contact with the locators 32.

It is also important that the stack of papers 24 be positioned longitudinally so that the holes 23 are aligned with the slots 132. To assist in positioning the stack of papers, it is advantageous to include a series of locator pins 30. The locator pins 30 can be removably inserted into holes in the guide plate 28. The stack of papers 24 is positioned by placing it over the locator pins so that the pins extend through the holes 23. Leaving the locator pins 30 in the holes 23 during binding would prevent the coil 36 from spiraling into the holes. Therefore, the locator pins must be removed prior to binding.

In alternative embodiments of the invention, the manually inserted locator pins 30 can be replaced by extendible and retractable pins located within the housing 16. The locator pins 30 can be mounted on a bar (not shown) within the housing 16 so that the pins extend through holes (not shown) in the guide plate 28. The bar and attached locator pins can then be raised or lowered so that the pins extend and retract using an actuation mechanism (not shown).

It is advantageous to place a downward directed force on the rear edge of the stack of papers 24 to hold them in position during binding. The preferred embodiment of the invention applies such a force using a paper hold down bar 34 (FIGS. 1 and 9–10) that is rotatably mounted within the housing 66. The paper hold down bar 34 includes a rotatably mounted finger tab 140 (FIGS. 1 and 9) that allows the operator to grab the tab and pull the hold down bar forward and downward onto the top of the stack of papers 24.

Figure 9:
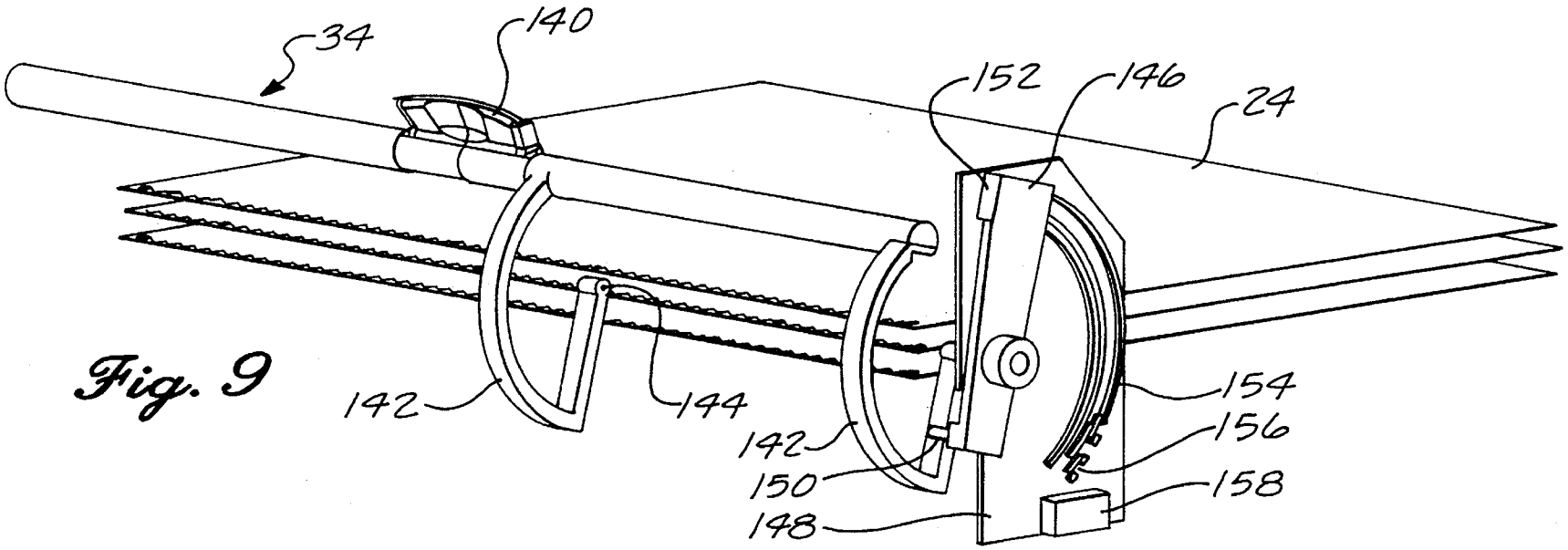
FIG. 9 is a perspective view of the paper hold down bar.
Figure 10:
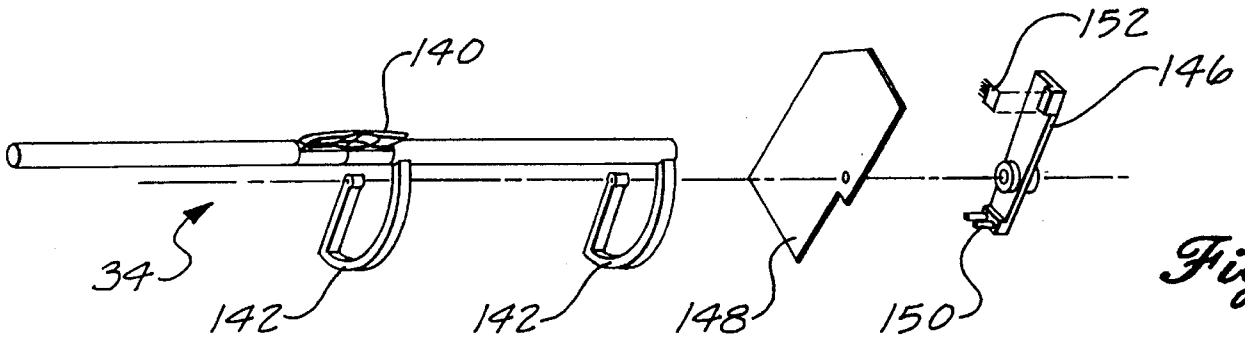
FIG. 10 is a partially exploded view of the paper hold down bar.

The hold down bar 34 is gravity or spring-biased so that the bar applies a downward directed force to the rear edge of the stack of papers 24. As illustrated in FIGS. 9 and 10, the hold down bar 34 is mounted on arcuate arms 142 which are in turn rotatably mounted to the binding cover 66 through the use of pivot pins that extend through apertures 144 in the arms 142.

The hold down bar 34 also provides an indication of the thickness of the stack of papers 24 to be bound. This indication of thickness is used to inform the operator of the optimum coil diameter that should be used to bind the stack of papers 24. The hold down bar 34 is attached to a wiper arm 146 at one end. The hold down bar 34 is supported by the housing 16 and the wiper arm 146 is rotatably mounted to a supporting circuit board 148 that is in turn attached to the housing 16. One end of the wiper arm 146 includes two opposing pins 150 that extend over opposing sides of one of the arms 142. The pins 150 trap the arm 142 between them so that rotation of the ann 142 causes a corresponding rotation of the wiper arm 146. The opposite end of the wiper arm 146 includes a plurality of finger contacts 152 (FIG. 10). The finger contacts 152 ride upon arcuate circuit traces 154 on the supporting circuit board 148 as the wiper arm 146 rotates. Each circuit trace 154 includes a series of insulating regions 156 which encode the angular position of the wiper arm using a gray code. One circuit trace has no insulating regions and provides continuity to the finger contacts.

As the wiper arm 146 and bar 34 rotate downward, one or more of the finger contacts 152 makes electrical contact with the circuit traces 154 to provide positional data on the location of the wiper arm 146 and hold down bar 34. The position of the wiper arm 142 corresponds to the continuity and the circuit traces 154 made by the finger contacts 152. The position can be read as binary code and output through the electrical connector 158. This positional data is then provided to a control system (not shown), such as a microprocessor, that in turn illuminates one of a series of indicators 38 (FIG. 1). The indicators 38 provide the operator a visual cue of the optimum size coil 36 that should be used during binding.

In alternate embodiments, the position of the paper hold down bar 34 and thus the thickness of the paper could be detected in other manners. For example, the finger contacts 152 could be replaced by a photoelectric sensor or microswitch and the circuit traces 154 could be replaced by a gray scale, coded optical shutters or cam ridges. The paper hold down bar 34 can also include fingers that extend outward from the bar to contact the top of the stack of papers 24 to hold them down.

A microswitch, photoelectric switch, or other type of switch can be located within the feeder housing 62 to detect when a coil 36 is placed within the housing. The switch provides a signal that causes the indicator 50 to be illuminated. The operator may then spiral the coil 36 into or out of the holes 22 in the stack of papers 24 by depressing either the left or right side of the binding button 46, respectively.

The structure and operation of the punch section 12 will now be described by reference to FIGS. 1 and 11–15. The punch section 12 (FIG. 11) is attached to the base 60 of the housing 12 and includes a drive motor 170, that moves an upper punch housing 178 toward and away from a lower punch housing 180. The lower punch housing 180 includes a slot 182 into which the stack of papers 24 is inserted and a series of holes 184 that extend through the lower housing. The upper housing 178 includes a punch ramp 186 and a series of punch pins 188 that extend through holes 220 in the upper housing. The upper housing 178 is slidably attached to the lower housing 180 using two opposing columns 214 that extend through holes 216 in the upper housing and into holes 218 in the lower housing 180.

The motor 170 is attached to a motor bracket 190 (FIG. 11) which is attached to the base 60. The drive shaft of the motor includes a drive gear 192 that engages a driven gear 194. The driven gear 194 is mounted on a shaft 196 that extends through and rotates within beatings 200 in lugs 198 located at either end of the lower punch housing 180. Opposing cam arms 202 are mounted on the shaft 196 to either side of the lower punch housing 180. The lower ends of the cam arms 202 are rotatably mounted to the shaft 196 using two-piece eccentrics 204 that extend through holes 206 in the lower end of the cam arms. As the driven gear 194 rotates, the eccentrics 204 rotate causing the cam arms 202 to reciprocate up and down with respect to the lower housing 180. The upper end 208 of the cam arms 202 are rotatably attached to the upper housing 178 through the use of bearings 210 and pivot pins 212.

Figure 12:
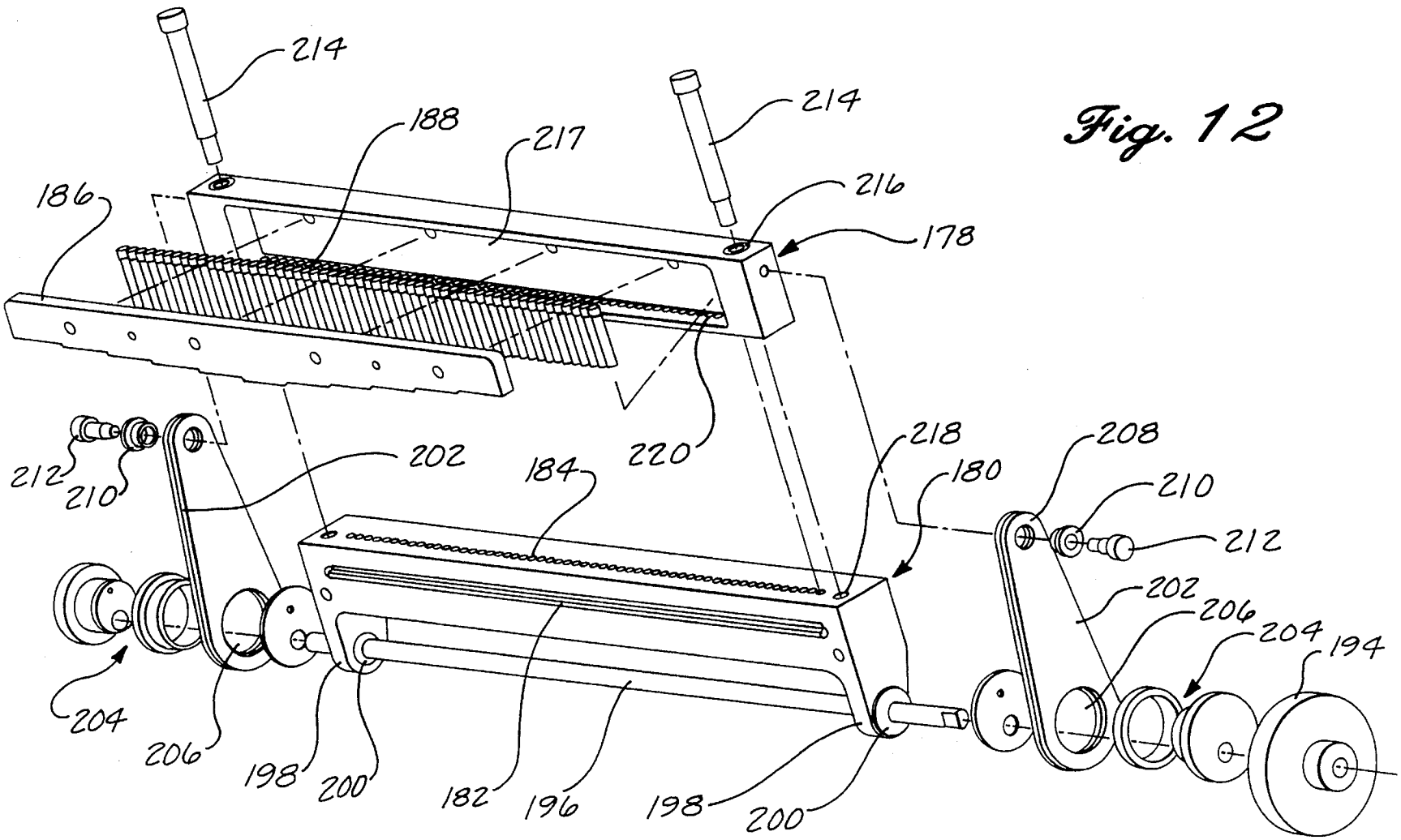
FIG. 12 is an exploded view of the punch of FIG. 11.
Figure 13:
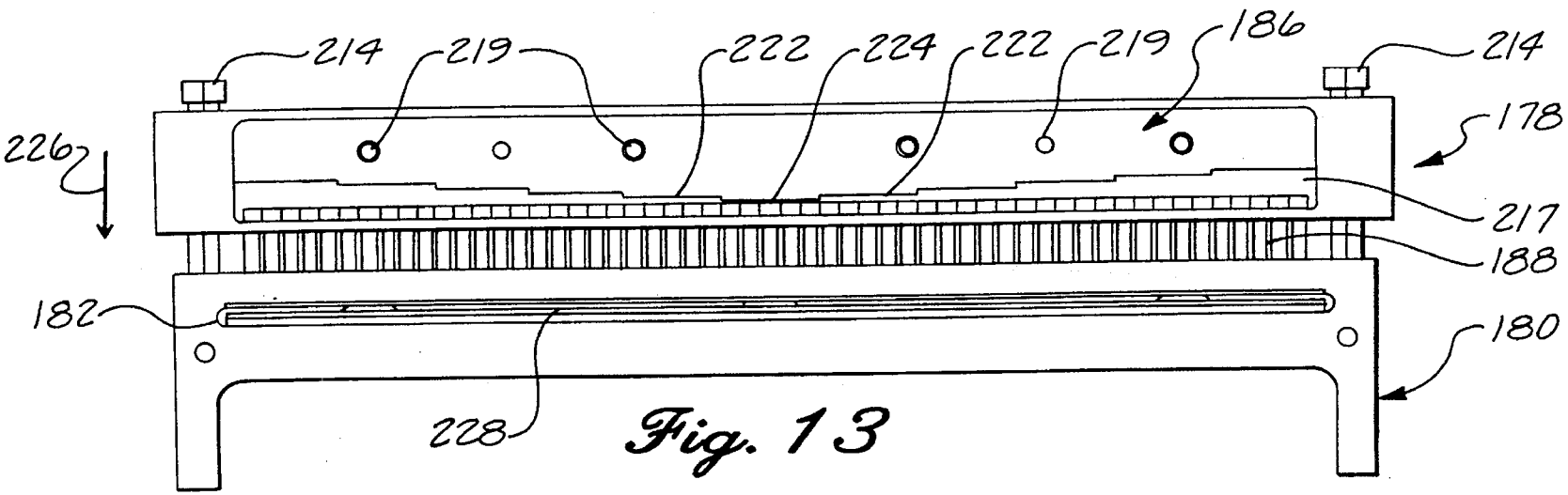
FIG. 13 is a plan view of the punch in its raised position.

As best illustrated in FIGS. 12 and 13, the upper housing 178 includes a longitudinal recess 217. The holes 220 extend through the lower wall of the recess 217 and are aligned with the holes 184 in the lower housing 180. The punch pins 188 are placed within the holes 220 and extend downward into the holes 184 in the lower housing 180. The punch pins 188 are maintained within the upper housing 178 by the ramp 186 that is located within the recess 217 and fastened to the upper housing 178 using fasteners 219. The lower surface of the ramp 186 facing the punch pins 188 includes a series of inclined steps 222 that rise upward from a center step 224. The surface of each step 222 and 224 is approximately parallel to the bottom wall of the recess 217.

Figure 14:
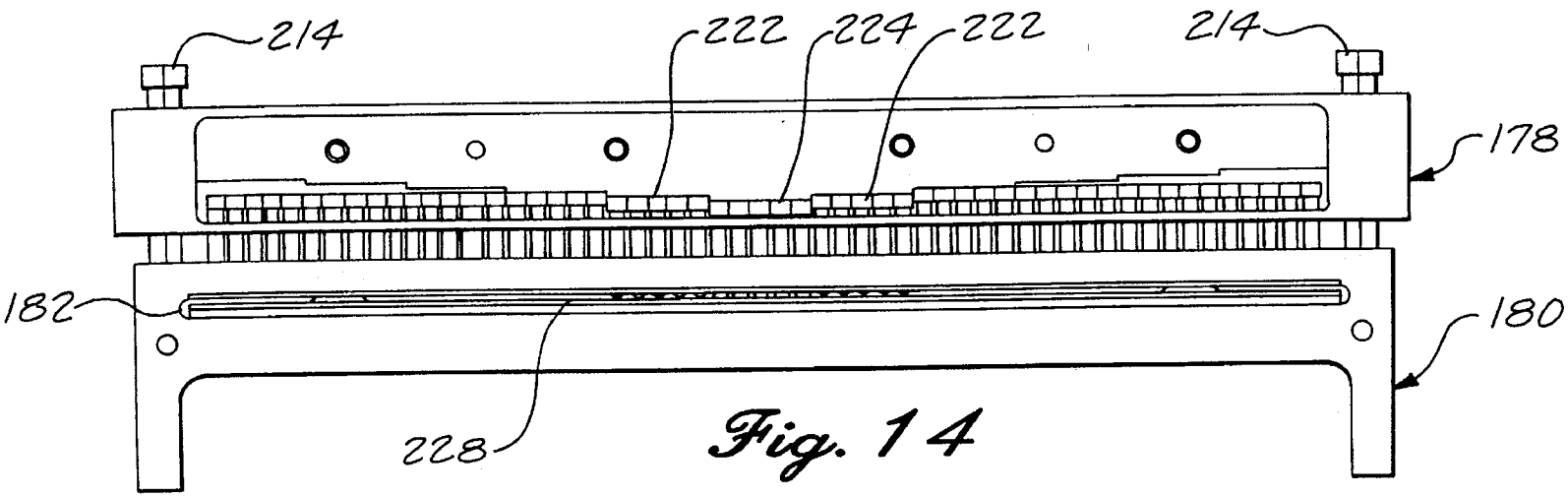
FIG. 14 is a plan view of the punch in its partially lowered position.
Figure 15:
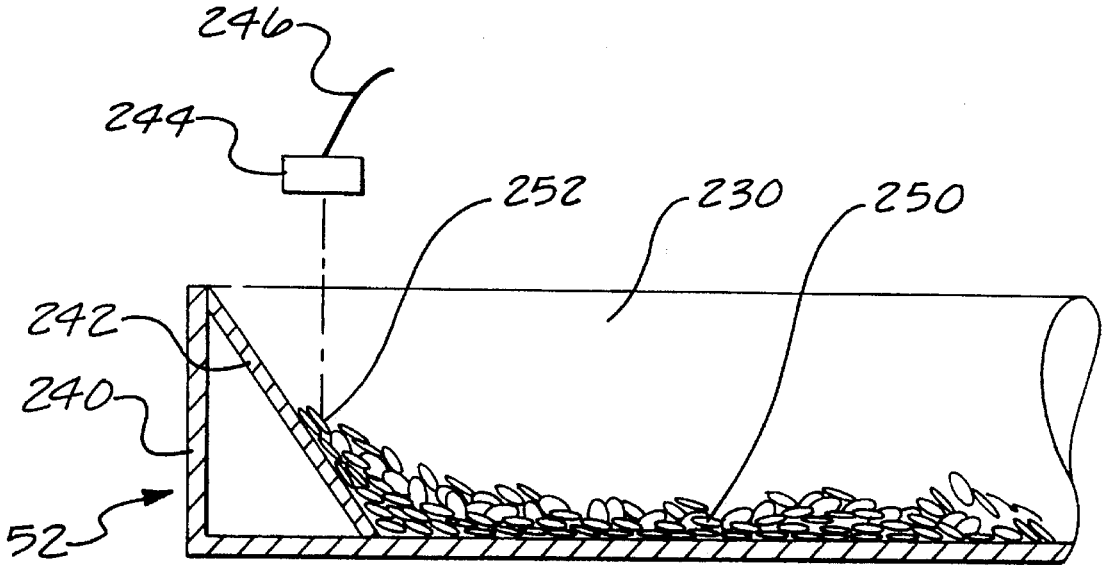
FIG. 15 is a cross section of one end of the wastebasket.

As best seen in FIGS. 13 and 14, as the cam arms 202 move downward, the upper housing 178 moves toward the lower housing 180 as illustrated by arrow 226 in FIG. 13. As the upper housing 178 moves downward, the punch pins 188 move downward through the holes 184 into contact with a stack of papers 228 that have been inserted into the slot 182 in the lower housing 180. As the lower housing 178 continues to move downward, further downward movement of the punch pins 188 is prevented by the resistance of the stack of papers 228, causing the punch pins 188 to move upward with respect to the upper housing 178 and ramp 186. As the housing 178 continues to move downward, the center step 224 contacts the punch pins 188 directly beneath it and pushes the punch pins through the stack of paper 228 forming holes in the stack of papers. Similarly, as the upper housing 178 continues to move downward, the steps 222 to either side of the center step 224 contact and push the corresponding punch pins downward through the stack of papers. The cascading punching continues from the center of the stack of papers outward until the upper housing 178 has reached the bottom of its stroke at which time it moves upward withdrawing the punch pins from the stack of papers 228. When the upper housing 178 reaches the top of its stroke, the motor 170 stops the movement of the punch thus completing the punching operation. The stack of papers 228 is then withdrawn and placed within the spiral binding section 14 as described above.

It is advantageous that the ramp 224 be configured to punch the stack of papers 228 from the center outward to prevent wrinkling or binding of the stack of papers within the punch. It is also advantageous to punch a few holes at a time in order to decrease the size of the motor relative to a punch which punches all the holes in the stack of papers at one time.

In alternate embodiments of the invention, a microswitch, photoelectric sensor or other type of sensor can be mounted on the punch to detect when the punch has reached the top of its stroke. The sensors provide a signal to a control circuit or mechanical apparatus (not shown) to shut down and stop the motor 170, thus stopping the punching operation. The motor may also be braked either electrically or mechanically when the punch reaches the top of its stroke.

In order to achieve good results with the punch, it is important that the stack of papers be fully and properly inserted into the slot 182 in the punch. To assist in proper insertion, the punch platform 20 includes an alignment wall 75 and one or more ribs 230 (FIG. 1). The wall 75 extends inward from the left edge of the binding platform and rearward to the opening 182 in the punch. The ribs 230 extend perpendicularly upward from the surface of the punch platform 20 from the front of the punch platform to the rear of the punch platform. As a stack of papers is inserted into the slot 18, the wall 75 and ribs 230 guide the stack of papers into the slot 182. In addition, the lower surface of the upper cover 70 can include a series of ribs (not shown) that extend downward to help align the stack of papers so that they extend into the slot 182. The punch may also include a spring or otherwise biased bar, fingers, or structure (not shown) that extends along the length of the slot 18 in front of the slot 182 in the punch. The bar, or fingers, etc., press down on the top of the stack of papers as they are inserted into the slot to help ensure that the stack of papers remain flat and slide into the slot 182.

It is also important that the stack of papers to be punched be inserted all the way to the rear of the slot 182 in the punch. If the stack of papers is not fully inserted, the resulting punched holes will not be properly positioned. To ensure that the stack of papers is fully inserted into the punch prior to punching, it is advantageous to include one or more sensors located near the rear of the slot 182. The sensors could be microswitches, photoelectric sensors, or other sensors positioned to detect when the stack of papers is fully inserted into the slot 182. In one embodiment, one sensor can be located to the right side of the punch and the other to the rear of the punch to detect when the paper is properly positioned to the right and rear of the slot 182, respectively. When the sensors detect that the stack of papers is fully inserted into the slot 182, they provide a signal to instruct a control system (not shown) to illuminate the indicator 48 (FIG. 1) on the front of the binding cover 66. An operator may then punch the stack of papers by pushing the punch button 26.

The wastebasket 52 is slidably mounted within the base 60 (FIG. 11) directly beneath the lower punch housing 180. As the stack of papers 228 (FIG. 13) is punched, the punch pins 188 force the wastepaper through the portion of the holes that extend from the bottom of the slot 182 through the lower portion of the punch housing 180 into the interior 230 of the wastebasket.

The wastebasket 52 includes a wall 242 that inclines downward and outward from the upper edge of the end 240 to the bottom of the wastebasket. A photoelectric or other type of sensor 244 is mounted directly above the wall 242 and is connected to a microprocessor (not shown) or other control system by an electrical cable 246. The sensor 244 provides an indication of the level of wastepaper 250 within the interior 230 of the wastebasket to the control system. When the wastepaper 250 reaches a pre-determined point 252 up the surface of inclined wall 242, the control system illuminates the trash indicator 56 (FIG. 1) thus informing the operator that the wastebasket 52 requires emptying. In alternate embodiments of the invention, other types of sensors can be used to provide the operator an indicator of when the wastebasket is full.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for spiral binding a stack of papers together as a unit, the apparatus comprising:

a coil feeder for rotatably feeding a preformed coil into a plurality of holes in the stack of papers, the feeder including:

a rotatably mounted roller;

a drive mechanism to rotate the roller; and a shoe spaced radially outward from the surface of the roller and positioned so that as the coil is fed into the coil feeder, one side of the exterior of the coil contacts the roller and the opposite, exterior side of the coil contacts the shoe, the shoe applying a force on the exterior of the coil to push the opposite exterior side of the coil into contact with the roller as the coil moves through the coil feeder.

2. The apparatus of claim 1, wherein the coil feeder includes a plurality of guides configured to maintain a proper pitch of the coil as it is fed into the stack of papers.

3. The apparatus of claim 2, wherein the guides include a slot inclined at approximately the same pitch as the coil.

4. The apparatus of claim 2, wherein the plurality of guides are spaced over at least a portion of the length of the stack of papers that are being spiral bound.

5. The apparatus of claim 2, wherein the guides are removable to allow guides configured to accommodate coils having different pitches to be used.

6. The apparatus of claim 1, further including means for providing an operator an indication of the proper coil size to be used in binding the stack of papers.

7. The apparatus of claim 1, further including a paper hold down bar for pressing the stack of papers into contact with the plurality of guides during binding.

8. The apparatus of claim 7, wherein the paper hold down bar is part of means for providing an operator an indication of the proper coil size to be used in binding the stack of papers.

9. The apparatus of claim 1, wherein the shoe is movable toward and away from the roller allowing the coil feeder to accept different diameter coils.

10. The apparatus of claim 1, wherein the shoe applies a greater force to a portion of the coil within the coil feeder closest the stack of papers.

11. The apparatus of claim 1, further comprising a punch for forming holes in the stack of paper.

12. The apparatus of claim 11, wherein the punch includes:

a reciprocating ramp, the ramp including a center step and side steps that incline upward on both sides of the center step;

a plurality of punch pins slidably mounted in the punch beneath the ramp; and an actuator for moving the ramp into contact with the punch pins so that the center step contacts and pushes the punch pins below it through the center of the stack of papers and then the side steps contact and push the punch pins below them through the stack of papers so that holes are punched in the center of the stack of papers first and then outward from the center of the papers to both edges of the stack of papers.

13. The apparatus of claim 12, further comprising means to provide an indication of when the stack of papers is properly inserted into the punch.

14. The apparatus of claim 11, further including a wastebasket to collect paper punched out by the punch, and means to provide an operator an indication of when the wastebasket requires emptying.

15. A punch for punching holes in one edge of a stack of papers so that the stack of papers may be spiral bound, the punch comprising:

a reciprocating ramp, the ramp including a center step and side steps that incline upward on both sides of the center step;

a plurality of punch pins slidably mounted in the punch beneath the ramp; and an actuator for moving the ramp into contact with the punch pins so that the center step contacts and pushes the punch pins below it through the center of the stack of papers and then the side steps contact and push the punch pins below them through the stack of papers so that holes are punched in the center of the stack of papers first and then outwardly from the center of the stack of papers to both edges of the stack of papers.

16. The punch of claim 15, further comprising means for providing an indication of when the stack of papers is properly inserted into the punch.

17. A method of spiral binding a stack of papers, the method comprising the steps of:

placing a stack of papers within a spiral binding apparatus;

placing a coil between a shoe and a rotatable roller so that one exterior side of the coil contacts the shoe and the opposite exterior side of the coil contacts the roller;

applying a force on one exterior side of the coil using the shoe to press the opposite, exterior side of the coil into contact with the roller;

rotating the roller to rotate the coil and spiral it into the stack of papers.

18. The method of claim 17, further comprising the step of maintaining the coil at approximately the same pitch as the coil is spiraled into the stack of papers using a plurality of guides.

19. The method of claim 17, further comprising the step of providing an operator an indication of the proper size coil to use to bind the stack of papers.

20. The method of claim 17, further comprising the step of punching holes along one edge of the stack of papers starting at the center of the edge of the stack of papers and then moving sequentially outward toward either end of the stack of papers.

21. The method of claim 17, further comprising the step of providing an operator an indication of when a wastebasket requires emptying.

22. An apparatus for spiral binding a stack of papers together as a unit, the apparatus comprising:

a coil feeder for rotatably feeding a preformed coil into a plurality of holes in the stack of papers, the feeder including a rotatably mounted roller, a drive mechanism to rotate the roller, and a shoe spaced radially outward from the surface of the roller and positioned so that as the coil is fed into the coil feeder, one side of the coil contacts the roller and the opposite side of the coil contacts the shoe, the shoe applying a force on the coil to push the coil into contact with the roller as the coil moves through the coil feeder; and a plurality of guides spaced over at least a portion of the length of the stack of papers and configured to maintain a proper pitch of the coil as it is fed into the stack of papers.

23. An apparatus for spiral binding a stack of papers together as a unit, the apparatus comprising:

a coil feeder for rotatably feeding a preformed coil into a plurality of holes in the stack of papers, the feeder including a rotatabty mounted roller, a drive mechanism to rotate the roller, a shoe spaced radially outward from the surface of the roller and positioned so that as the coil is fed into the coil feeder, one side of the coil contacts the roller and the opposite side of the coil contacts the shoe, the shoe applying a force on the coil to push the coil into contact with the roller as the coil moves through the coil feeder; and a plurality of guides configured to maintain a proper pitch of the coil as it is fed into the papers, the guides being removable to allow guides configured to accommodate coils having different pitches to be used.

24. An apparatus for spiral binding a stack of papers together as a unit, the apparatus comprising:

a coil feeder for rotatably feeding a preformed coil into a plurality of holes in the stack of papers, the feeder including:

a rotatably mounted roller;

a drive mechanism to rotate the roller; and a shoe spaced radially outward from the surface of the roller and positioned so that as the coil is fed into the coil feeder, one side of the coil contacts the roller and the opposite side of the coil contacts the shoe, the shoe applying a force on the coil to push the coil into contact with the roller as the coil moves through the coil feeder, and means for providing an operator an indication of the proper coil size to be used in binding the stack of papers.

25. An apparatus for spiral binding a stack of papers together as a unit, the apparatus comprising:

a coil feeder for rotatably feeding a preformed coil into a plurality of holes in a stack of papers, the feeder including a rotatably mounted roller, a drive mechanism to rotate the roller and a shoe spaced radially outward from the surface of the roller and positioned so that as the coil is fed into the coil feeder, one side of the coil contacts the roller and the opposite side of the coil contacts the shoe, the shoe applying a force on the coil to push the coil into contact with the roller as the coil moves through the coil feeder; and a paper hold-down bar for pressing a stack of papers into contact with a plurality of guides configured to maintain a proper pitch of the coil as the coil is fed into the stack of papers during binding.

26. An apparatus for spiral binding a stack of papers together as a unit, the apparatus comprising:

a coil feeder for rotatably feeding a preformed coil into a plurality of holes in a stack of papers, the feeder including a rotatably mounted roller, a drive mechanism to rotate the roller, and a shoe spaced radially outward from the surface of the roller and positioned so that as the coil is fed into the coil feeder, one side of the coil contacts the roller and the opposite side of the coil contacts the shoe, the shoe applying a force on the coil to push the coil into contact with a roller as the coil moves through the coil feeder; and a punch for forming holes in the stack of paper.

27. The apparatus of claim 26, wherein the punch includes:

a reciprocating ramp, the ramp including a center step and side steps that incline upward on both side of the center step;

a plurality of punch pins slidably mounted in the punch beneath the ramp; and an actuator for moving the ramp into contact with the punch pins so that the center step contacts and pushes the punch pins below it through the center of the stack of papers and then the side steps contact and push the punch pins below them through the stack of papers so that holes are punched in the center of the stack of papers so that the holes are punched in the center of the stack of papers first and then outward from the center of the papers to both edges of the stack of papers.

28. The apparatus of claim 26, further including a wastebasket to collect paper punched out by the punch, and means to provide an operator an indication of when the wastebasket needs emptying.

29. A method of spiral binding a stack of papers, the method comprising the steps of:

placing a stack of papers within a spiral binding apparatus;

providing an operator an indication of the proper sized coil to be used to bind the stack of papers;

placing a coil between a shoe and a rotatable roller so that one side of the coil contacts the shoe and the opposite side of the coil contacts the roller;

applying a force on one side of the coil using the shoe to press the opposite side of the coil into contact with the roller; and rotating the roller to rotate the coil and spiral it into the stack of papers.

30. A method of spiral binding a stack of papers, the method comprising the steps of:

punching holes along one edge of the stack of papers, staging at the center of the edge of the stack of papers and moving sequentially outward toward either end of the stack of papers;

placing the stack of papers within a spiral binding apparatus;

placing a coil between a shoe and a rotatable roller such that one side of the coil contacts the shoe and the opposite side of the coil contacts the roller;

applying a force on one side of the coil using the shoe to press the opposite side of the coil into contact with the roller; and rotating the roller to rotate the coil and spiral it into the stack of papers.

31. A method of spiral binding a stack of papers, the method comprising the steps of:

placing a stack of papers within a spiral binding apparatus;

placing a coil between a shoe and a rotatable roller so that one side of the coil contacts the shoe and the opposite side of the coil contacts the roller;

applying a force on one side of the coil using the shoe to press the opposite side of the coil into contact with the roller;

rotating the roller to rotate the coil and spiral it into the stack of papers; and providing an operator an indication of when a wastebasket requires emptying.

* * * * *